United States Patent [19]

Zahlaus

[11] Patent Number: 4,889,467

[45] Date of Patent: Dec. 26, 1989

[54] TOOLING ASSEMBLY FOR ROD MATERIAL

[75] Inventor: Helmut Zahlaus, Kriftel, Fed. Rep. of Germany

[73] Assignee: Heinz RUHL, D-Ochsenfurt, Fed. Rep. of Germany

[21] Appl. No.: 136,807

[22] Filed: Dec. 22, 1987

[30] Foreign Application Priority Data

Dec. 24, 1986 [DE] Fed. Rep. of Germany ..... 3644482

[51] Int. Cl.[4] ..... B65G 47/52

[52] U.S. Cl. ..... 414/746.2; 198/463.5; 414/746.4

[58] Field of Search ..... 414/745, 748, 745.9, 414/746.2, 746.4; 198/463.5

[56] References Cited

U.S. PATENT DOCUMENTS

| | | | |
|---|---|---|---|
| 1,659,848 | 2/1928 | Wilson | 198/463.5 |
| 2,043,556 | 6/1936 | Protin | 198/463.5 X |
| 2,820,573 | 1/1958 | McConnell | 198/463.5 X |
| 2,893,348 | 7/1959 | Pearson | 198/463.5 X |
| 2,923,952 | 2/1960 | Sawdey | 414/748 X |
| 3,913,751 | 10/1975 | Friedman | 414/748 X |

FOREIGN PATENT DOCUMENTS

| | | | |
|---|---|---|---|
| 3243492 | 5/1984 | Fed. Rep. of Germany | 414/748 |
| 246461 | 11/1969 | U.S.S.R. | 414/748 |

*Primary Examiner*—Frank E. Werner
*Assistant Examiner*—Janice Krizek
*Attorney, Agent, or Firm*—Beveridge, DeGrandi & Weilacher

[57] ABSTRACT

An assembly is suggested for loading and unloading of rod material (10, 40, 48) are going to be tooled in a tooling machine (16). To this effect, swinging arms are arranged (24) laterally to the tooling machine (16), by which arms at the same time material to be tooled and such already tooled can be lifted in order to be conveyed to the tool (18) of the tooling machine (16) or, respectively, away from the tool (18) to a place of deposit (20).

4 Claims, 3 Drawing Sheets

TOOLING ASSEMBLY FOR ROD MATERIAL

DESCRIPTION

Figure 1:
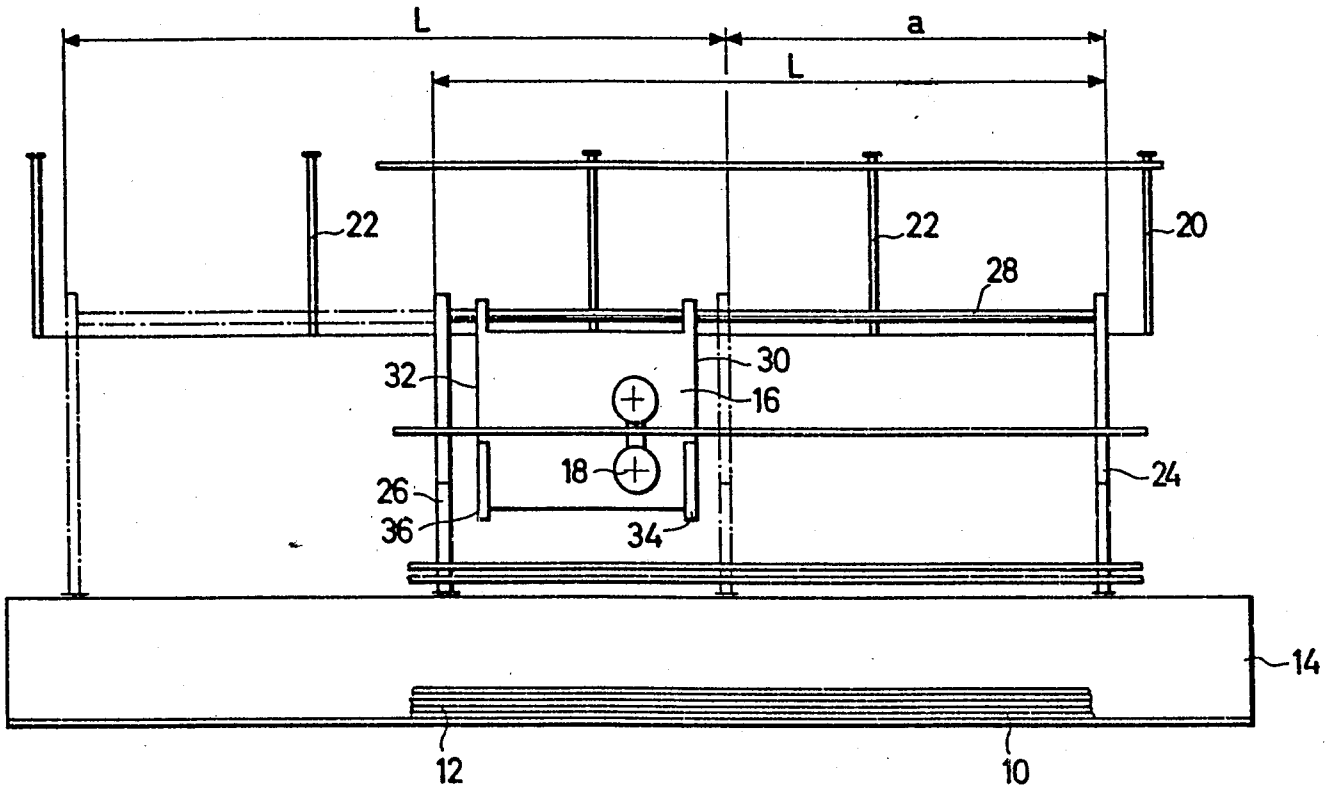

The invention relates to an assembly for tooling rod material, like reinforcement steels, comprising a tool with a material stock arranged in front thereof and a deposit for the processed material arranged behind it.

The tools in such assemblies can be designed like bending slides, which can be displaced parallelly to the longitudinal axis of the rod material. In order to feed the material to the bending carriage, the material is taken from a material stock and put into the bending slide manually or by means of auxiliary devices. After the tooling the material is then removed again manually or with auxiliary means, where the auxiliary means for feeding or, respectively, removing the material must be actuated separately from each other. Due to this fact, the output capacity of a respective tool cannot be fully utilized. This, however, is worth striving for, especially in the light of the high investments to be made for such devices.

It is the object of the present invention to design an assembly of the above mentioned kind in such a manner that a continuous feed and discharge of the rod material to be tooled or, resp. tooled, to the tool or, respectively, away from it, is obtained with means of simple construction, without requiring separate devices for feeding and discharging.

According to the invention, the material can be transported not only to the tool but also after the tooling away from it by means of arms swinging in a body and arranged on both sides of the tool. Thus a loading and unloading device for rod material is provided, which can be called a fork device, having arms slewable in a body at the side close to the tool, thus the processing machine, said arms being positively joined with a shaft. Hereby the shaft is extending in transport direction of the material as seen from behind the tool, so that on swivelling of the arms, material to be tooled and tooled material can be lifted simultaneously and conveyed to the tool or, respectively, to the deposit.

In an embodiment of the invention, a ramp-shaped element that can also be called a feeding runner, is arranged in front of the tool and inclined thereto, on which the material grasped by the arms can be placed in order to subsequently slide to the tool.

In order that material to be tooled and tooled material, being simultaneously grasped by the arms, cannot collide, it is furtheron suggested to provide each arm with a step extending in the area of the ramp-shaped element, and in which step the material placed in front of the tool is held when it is lifted. Consequently the arm is subdivided into two ranges, to-wit: a rear section being far from the swing axis, where the material to be tooled is placed, and from where it can slide to the step only; and a front section where the tooled material is grasped and from where it glides on the place of deposit. Thereby it is understood that the arms are swung out to such an extent that the step is positioned above the feed runner until the arms are lowered again to their original position, so that the rod-shaped material can be placed on the feed runner or, respectively, runners and from there glide to the tool.

According to another embodiment of the invention, the shaft with the positively integrated arms extending therefrom is capable of parallel motion to the rod material in order to provide the chance for lifting it in the points so that a binding does not take place; for such material can easily have lengths of 20 meters.

To make sure that the tooled material is delivered to the deposit, like e.g. a storing frame construction, without the problem that any material is left on the work table surrounding the tool, it is suggested to have the arms extending over their swinging axis in direction of the deposit.

Concerning the angle of inclination of the ramp-shaped element, it still is to mention that this angle is greater than the angle of friction of the rod material in order to make sure that it will automatically glide to the tool along the surface of the element.

Further details, advantages, and characteristics of the invention will result not only from the claims, the characteristics to be taken therefrom, on its own and/or in combination, but also from the following description of a preferred embodiment example shown in the accompanying drawing, where FIG. 1 is a top view of an assembly for tooling rod material; and FIGS. 2 to 5 are side views of the assembly according to FIG. 1 at different tooling times.

FIG. 1 shows an assembly for tooling rod material, like reinforcement steels, comprising among others a material stock (12) with serving platform (14), a tooling machine (16) with tool (18), as well as deposit grates (22) surrounding a deposit (20).

Laterally to the tooling machine (16) and thus to the tool (18), swinging arms (24) and (26) are arranged being rigidly connected with a shaft (28), which is supported by the tooling machine (16) and extending parallelly to the longitudinal axes of the rod material (10). The shaft (28), with respect to the transport direction of the rod material (10) from the serving platform (14) via the tool (18) to the deposit ((20), is here arranged in the rear part, thus behind the tool (18).

At both sides of the tool (18), and preferably within the range of the sides (30) and (32) of the tooling machine (16), ramp-shaped elements (34) and (36) are arranged, being inclined in direction of the tool (18), and which can also be called feed runners. In addition, each arm (24), (26) has a step (38) serving as stop for the rod material (40) placed on the free ends of the arms (24), (26) then when the arms (24), (26) according to FIG. 3 (position B) are swivelled into a lifted position.

By the arrangement and construction of the arms (24) and (26), as well as the presence of the feed runners (34) and (36), according to the invention the rod material (10) is loaded and unloaded to or, respectively, away from the tool (18) without requiring any manual actions or additional auxiliary means.

Figure 2:
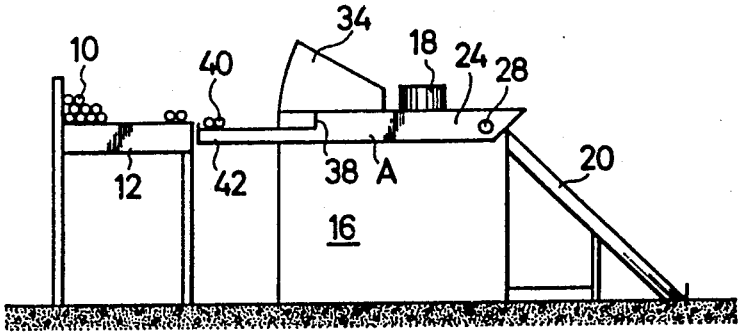
Figure 3:
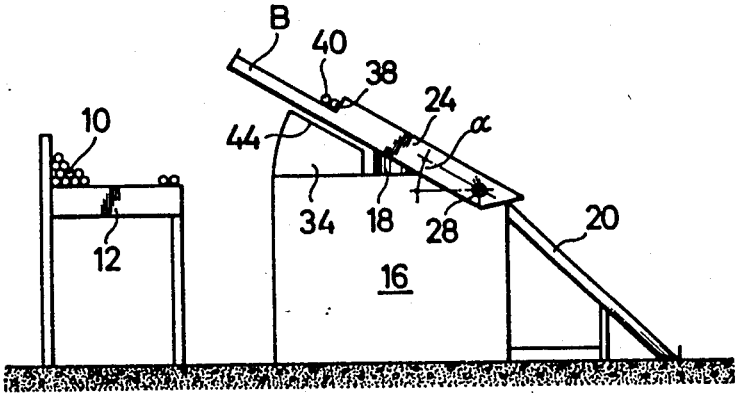

The sequence of operations for loading and unloading the rod material is as follows:

According to FIG. 2 the rod material is placed on that end (42) of the arms (26) and (24) being away from the shaft (28). There this material has the reference mark (40). Thereafter the arms (24), (26) are lifted from the original position A to position B, whereby the material (40) is gliding against the stop defined by the step (38). In position B the step (38) is situated above the feed runners (34), (36) being arranged in front of the tool (18). Now when the arm (24) is returned to the original position A (FIG. 4), the material (40) is placed on the upper edges (44) of the feed runners (34) and (36) in order to subsequently glide automatically to the tool (18) in a work channel eventually being installed there.

Figure 4:
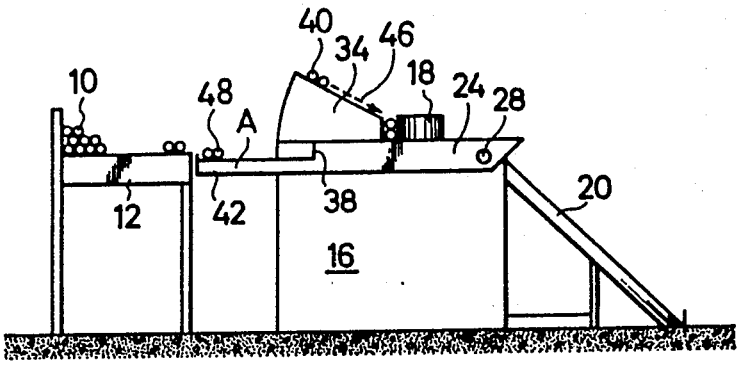
Figure 5:
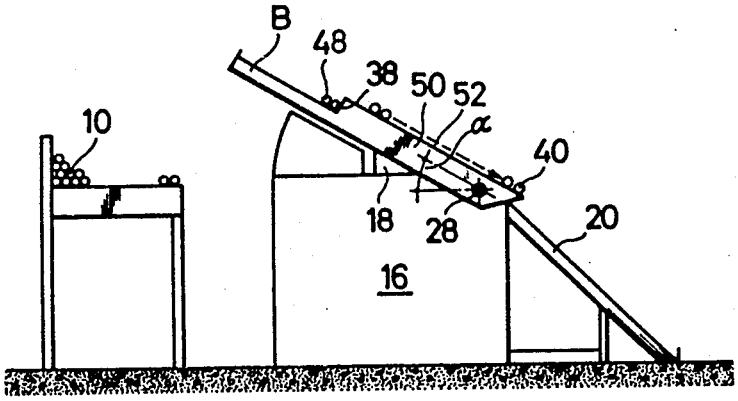

This is indicated in FIG. 4 by the broken arrow (46). Now the tooling in the machine (16) with the tool (18) can start. At the same time fresh rod-shaped material (48) is placed on the end (42). As soon as the tooling operation is completed, the arm (24) is again lifted to the position B, where on the one hand the material (48) is gliding against the step (38), and at the same time the tooled material is grasped and lifted by that section (50) of the arm (24) or, respectively (26) extending from the shaft (28), in order to glide along the surface (52) of section (50) into the deposit (20). Now the arm (24), (26) is returned to position A and the sequence according to FIG. 4 is repeated once more.

Consequently the teaching according to the invention renders possible an automatic loading an unloading of rod material to be tooled to or, respectively, away from a tooling machine by means of simple construction, without requiring any separate devices for the loading and unloading. Since, moreover, the arms (24) and (26) extending from the shaft (28) that render possible the loading and unloading, are rigidly connected with the tooling machine (16), said machine can be displaced without any problems, whereby a synchronous co-motion of the shaft (28) and thus of the arms (24) and (26) takes place. Said arms however, can likewise be displaced relative to the tooling machine (16) in order to grasp the rod material (10) in such a manner that a sagging does not take place. This is of special importance when the rod material shall be tooled simultaneously by several tooling machines being arranged in alignment to each other. Longitudinal displacement of the shaft (28) with its rigidly connected arms (24) and (26) is illustrated in FIG. 1 by the dot-dash lines.

I claim:

1. A tooling assembly of tooling a rod material and transporting the material in a transport direction from a material stock to a tool, and from over the tool to a place of deposit for the tooled material, the tooling assembly being characterized by the following features:

(a) arms pivotably moved as a unit extend rigidly from a shaft, and the swivel axis of the arms extends perpendicularly to the transport direction and is located between the tool and the place of deposit, (b) between the material stock and the tool, a ramp-shaped element inclined toward the tool is arranged, on which the rod material can be placed by means of the arms, (c) the angle of inclination of the ramp-shaped element is larger than the angle of friction of the rod material to enable the automatic gliding of the rod material therealong, (d) the arms, each pivotable on one side of the tool, each have a step located in a section thereof which becomes situated above the ramp-shaped element when the arms are pivoted upwardly with respect to the tool from a lowered position to a lifted position, whereby, when the arms are pivoted at their lifted position, rod material held on the arms between the material stock and the tool is guided by the arms to the steps to be stopped thereby above the ramp-shaped element and material held in the tool is lifted from the tool and guided by the arms to the place of deposit and, when the arms are pivoted to their lowered position, the material stopped by the steps is provided to the ramp-shaped element and is guided thereby to the tool.

2. An assembly according to claim 1, characterized in that the shaft is repositionable along its longitudinal axis.

3. An assembly according to claim 1, characterized in that the shaft extends in a supporting construction housing the tool.

4. An assembly according to claim 1, characterized in that the arms each have a portion extending beyond the swivel axis of the shaft in the transport direction.

* * * * *